US007014536B2

(12) United States Patent
Sakai

(10) Patent No.: US 7,014,536 B2
(45) Date of Patent: Mar. 21, 2006

(54) WAFER POLISHING METHOD

(75) Inventor: Toshiyuki Sakai, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/000,187

(22) Filed: Dec. 1, 2004

(65) Prior Publication Data

US 2005/0118933 A1 Jun. 2, 2005

(30) Foreign Application Priority Data

Dec. 2, 2003 (JP) ..... 2003-402485

(51) Int. Cl.
*B24B 1/00* (2006.01)

(52) U.S. Cl. ..... 451/41; 451/54; 451/63

(58) Field of Classification Search ..... 451/41, 451/43, 44, 54, 59, 63
See application file for complete search history.

(56) References Cited

U.S. PATENT DOCUMENTS

2003/0104765 A1 * 6/2003 Maeda et al. ..... 451/41
2003/0199238 A1 * 10/2003 Moriyama et al. ..... 451/56

FOREIGN PATENT DOCUMENTS

JP 2003-71714 3/2003

* cited by examiner

*Primary Examiner*—Jacob K. Ackun, Jr.
(74) *Attorney, Agent, or Firm*—Smith, Gambrell & Russell LLP

(57) ABSTRACT

A wafer polishing method which can prevent polishing swarfs from entering the gap between the periphery of a wafer and a protective tape when the back surface of the wafer is dry polished with a polishing pad after the protective tape is affixed onto the front surface of the wafer, the method comprising the steps of cutting an arcuate chamfered portion formed at the periphery of the wafer to form a precipice at the periphery of the wafer; affixing the protective tape onto the surface to be held on the chuck table of a polishing machine, of the wafer; and placing the wafer on the chuck table in such a manner that the side of the protective tape comes into contact with the chuck table to dry polish the surface of the wafer with a polishing means.

4 Claims, 3 Drawing Sheets

(a)

(b)

WAFER POLISHING METHOD

FIELD OF THE INVENTION

The present invention relates to a wafer polishing method and, more specifically, to a wafer polishing method for affixing a protective tape to a front surface of a wafer having semiconductor chips formed thereon, such as a semiconductor wafer, and polishing the back surface of the wafer.

DESCRIPTION OF THE PRIOR ART

After the back surface of a semiconductor wafer having a plurality of semiconductor chips such as IC's or LSI's formed on the front surface is ground to a predetermined thickness, the wafer is divided into individual semiconductor chips which are used in electric appliances such as mobile phones, personal computers or the like. A grinding device for grinding the back surface of this semiconductor wafer comprises a chuck table for holding a wafer and a grinding means including a grinding wheel for grinding the wafer held on the chuck table while grinding water is supplied to the wafer, and can grind the back surface of the wafer efficiently.

However, when the back surface of the wafer is ground with the grinding wheel, there are a problem that a saw mark is formed on the ground surface and fine cracks are formed in the inside of the wafer, thereby greatly reducing the breaking strength of the chips. To cope with this problem, for example, JP-A 2003-71714 discloses a polishing machine in which the ground surface of the wafer is dry polished with a polishing pad manufactured by incorporating abrasive grains into a soft member and fixing them with a suitable bond to remove a saw mark and cracks, thereby improving the breaking strength of the chips, and this polishing machine has been put to practical use.

However, when a protective tape P is affixed onto the front surface of the wafer W and the back surface of the wafer is polished as shown in FIG. 3(*a*), powdery polishing swarfs enter a gap between an arcuate chamfered portion M formed at the periphery of the wafer W and the protective tape P to raise up the periphery of the wafer W, thereby damaging the wafer, as shown in FIG. 3(*b*) which is a partially enlarged view of the wafer.

Further, as shown in FIG. 3(*c*), the wafer W whose back surface has been polished is turned upside down, is put on a dicing tape T and diced while it is supported on a dicing frame F via the dicing tape T to be divided into individual semiconductor chips. The polishing swarfs adhered to the periphery of the wafer W are sandwiched between the dicing tape T and the wafer W when it is put on the dicing tape T, thereby damaging the semiconductor chips at the time of dicing.

SUMMARY OF THE INVENTION

The present invention has been made in the light of the above fact, and it is a technical subject of the present invention to provide a wafer polishing method which can prevent polishing swarfs from entering a gap between the periphery of the wafer and the protective tape when the back surface of the wafer is dry polished with a polishing pad after the protective tape is affixed onto the front surface of the wafer.

The inventor of the present invention has conducted intensive studies and experiments and as a result, has paid attention to the fact that polishing swarfs are easily accumulated in a fissure-like depression formed by the chamfered portion and the protective tape due to the shape of the arcuate chamfered portion at the periphery of the wafer, and have confirmed that the problem of the prior art can be efficiently eliminated by improving the shape of this portion.

That is, according to the present invention, there is provided a method of polishing a wafer with a polishing machine comprising a chuck table for holding a wafer and a polishing means for dry polishing the surface of the wafer held on the chuck table with a polishing pad that is manufactured by incorporating abrasive grains into a soft member, the method comprising the steps of:

- cutting an arcuate chamfered portion formed at the periphery of the wafer to form a precipice at the periphery of the wafer;
- affixing a protective tape onto the surface to be held on the chuck table, of the wafer; and
- placing the wafer on the chuck table in such a manner that the protective tape side comes into contact with the chuck table to dry polish the surface of the wafer by the polishing means.

Preferably, the protective tape protrudes 0 to 1.0 mm from the precipice at the periphery of the wafer. Preferably, the soft member of the polishing pad is a felt.

According to the wafer polishing method of the present invention, as the arcuate chamfered portion at the periphery of the wafer is cut to form a precipice at the periphery of the wafer, a fissure-like depression formed by the arcuate chamfered portion at the periphery of the wafer and the protective tape is removed, thereby making it possible to prevent polishing swarfs from entering and accumulating in the gap between the arcuate chamfered portion and the protective tape and to prevent the damage of the wafer. Since the entry and accumulation of the polishing swarfs can be prevented, a problem that the semiconductor chip is damaged by the polishing swarfs at the time when the semiconductor wafer is diced in the subsequent step can be avoided.

DETAILED DESCRIPTION OF THE PREFERRED EMBODIMENT

The wafer polishing method constituted according to a preferred embodiment of the present invention will be described in more detail hereinunder with reference to the accompanying drawings which illustrate the polishing of a semiconductor wafer.

Figure 1:
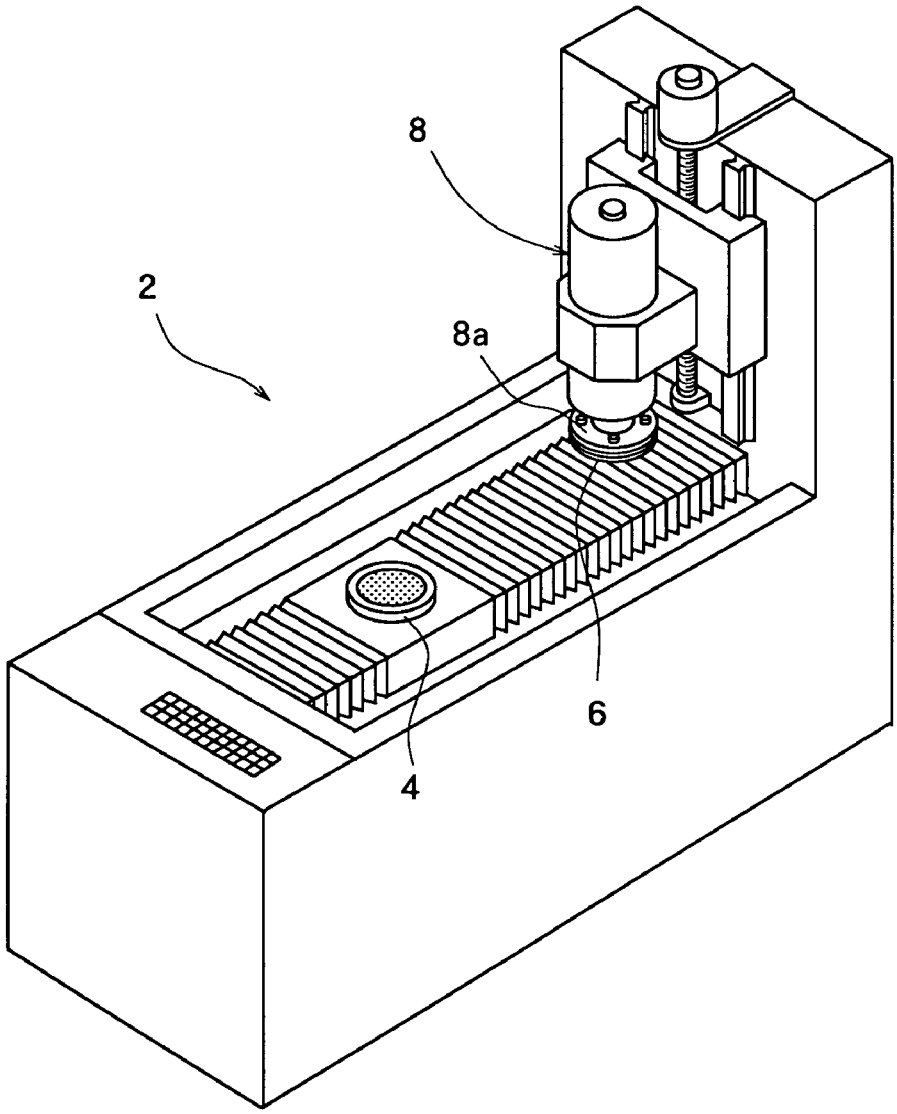
FIG. 1(*a*) is a perspective view of a polishing machine for a semiconductor wafer used in the wafer polishing method of the present invention and FIG. 1(*b*) is an enlarged view of the front (obverse) and back (reverse) surfaces of the polishing pad of polishing means.
Figure 1:
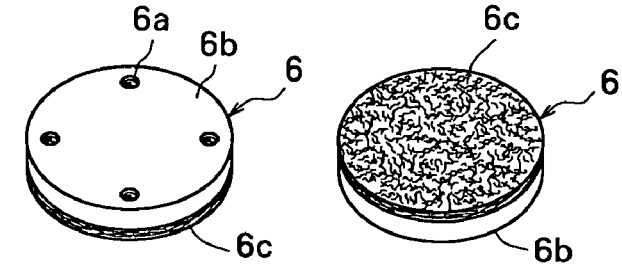

With reference to FIG. 1(*a*), a polishing machine denoted as a whole by numeral 2 used to polish a semiconductor wafer will be first described. The polishing machine 2 comprises a chuck table 4 for suction-holding a wafer and a polishing means 8 for dry polishing the surface of the wafer held on the chuck table 4 with a polishing pad 6.

The chuck table 4 has a top surface as a placing surface for placing the wafer, and can be rotary-driven and move back and forth relative to the polishing pad 6 freely. The placing surface is made of a suitable porous material such as a porous ceramic, and is connected to a suction means.

The polishing means 8 has the disk-like polishing pad 6 at the lower end of a rotary shaft 8*a* that extends vertically and is rotary-driven. Describing the polishing pad 6 with reference to an enlarged view of FIG. 1(*b*), the polishing pad 6 has a support board 6*b* made of an appropriate material such as aluminum or the like and having attachment screw holes 6*a* for attaching it to the rotary shaft 8*a* and a soft member 6*c* that contains abrasive grains blended therein and is bonded to the support board 6*b* (the polishing pad 6 will be described in more detail later.).

The wafer polishing method according to the present invention comprises the steps of:

(1) cutting an arcuate chamfered portion formed at the periphery of the wafer to form a precipice at the periphery of the wafer;

(2) affixing a protective tape to the surface to be held on the chuck table of the wafer; and (3) placing the wafer on the chuck table in such a manner that the protective tape side comes into contact with the chuck table to dry polish the surface of the wafer with the polishing means.

The semiconductor wafer has a plurality of semiconductor chips formed on the "front surface" of a silicon wafer and the "back surface" of the semiconductor wafer is polished.

Each step of the above-described wafer polishing method will be described in detail with reference to mainly FIG. 2(*a*) and FIG. 2(*b*).

Figure 2:
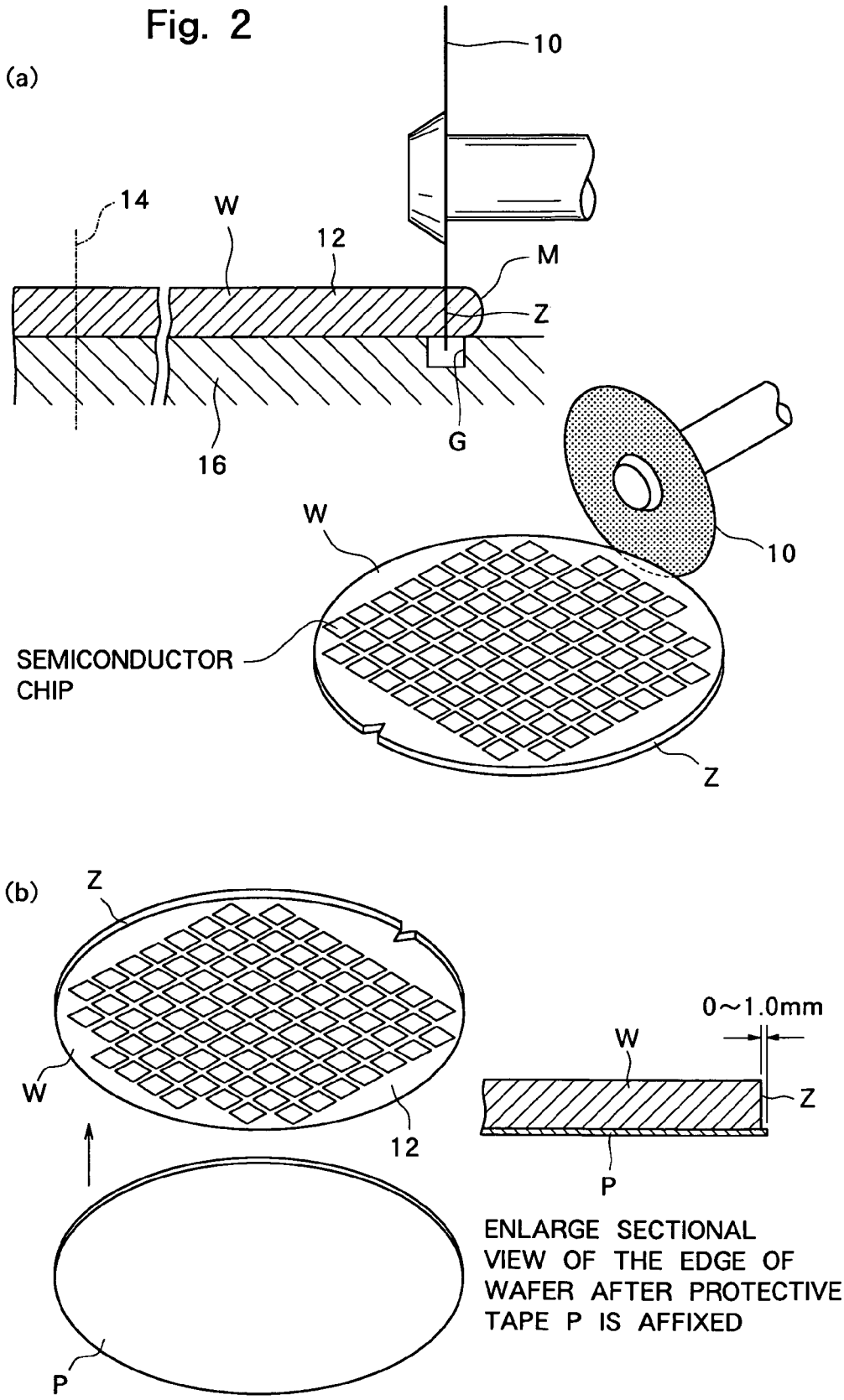
FIG. 2(*a*) is a diagram for explaining the formation of a precipice at the periphery of the wafer and FIG. 2(*b*) is a diagram for explaining the affixture of a protective tape in the wafer polishing method of the present invention.

(1) Formation of Peripheral Surface of Wafer:

As shown in FIG. 2(*a*), the arcuate chamfered portion M formed at the periphery of the wafer W is cut with a disk-like rotary blade 10 to form a precipice Z substantially at right angles with the surface of the wafer at the periphery of the wafer W. The blade 10 is preferably a blade manufactured by bonding diamond abrasive grains with an appropriate bond, and is used to individually divide a plurality of semiconductor chips formed on the front surface of the wafer W in the production process of a semiconductor chip, for example.

The cutting of the chamfered portion M of the wafer W with the blade 10 to form the precipice Z is carried out by mounting the wafer W on a jig 16 having a loop blade escape groove G with the axis 14 as the center and turning the jig 16 at a speed of 1 rpm on the axis 14 for the blade 10 which turns at, for example, 30,000 rpm. Thus, the chamfered portion M is cut easily without fail to form the precipice Z.

The cutting of the chamfered portion M and formation of the precipice Z can be also carried out easily with a core drill, that is, a drill having no blade at the center thereof.

(2) Affixment of Protective Tape:

As shown in FIG. 2(*b*), the protective tape P is affixed to the surface 12, on which a plurality of the semiconductor chips are formed, to be held on the chuck table 4 (FIG. 1(*a*)), of the wafer W having the precipice Z at the periphery. On this occasion, the protective tape P is affixed in such a manner that its periphery protrudes 0 to 1.0 mm from the precipice Z at the periphery of the wafer W.

This protective tape P is formed by applying an ultraviolet light curable adhesive or thermosetting adhesive to one side of a film or sheet of a suitable synthetic resin such as a polyester.

(3) Polishing:

As described above, the wafer W having the precipice Z and the protective tape P affixed thereto is placed on the placing surface of the chuck table 4 in such a manner that the side of the surface 12, on which the protective tape P has been affixed and which is the "front surface" of the wafer W, comes into contact with the placing surface, and the "back surface" of the wafer W is polished with the polishing means 8.

To dry polish the semiconductor wafer W by the polishing method of the present invention, a felt grinding wheel formed by impregnating a felt with abrasive grains and fixing the abrasive grains with a bond is preferably used as the soft member 6*c* of the polishing pad 6. The felt may be made of wool, a synthetic fiber such as polyester or nylon, or a natural fiber such as cotton or hemp. Silica or diamond abrasive grains having a particle diameter of 0.01 to 100 $\mu$m are impregnated into the felt and bonded in the felt with a phenolic resin-based adhesive.

Figure 3:
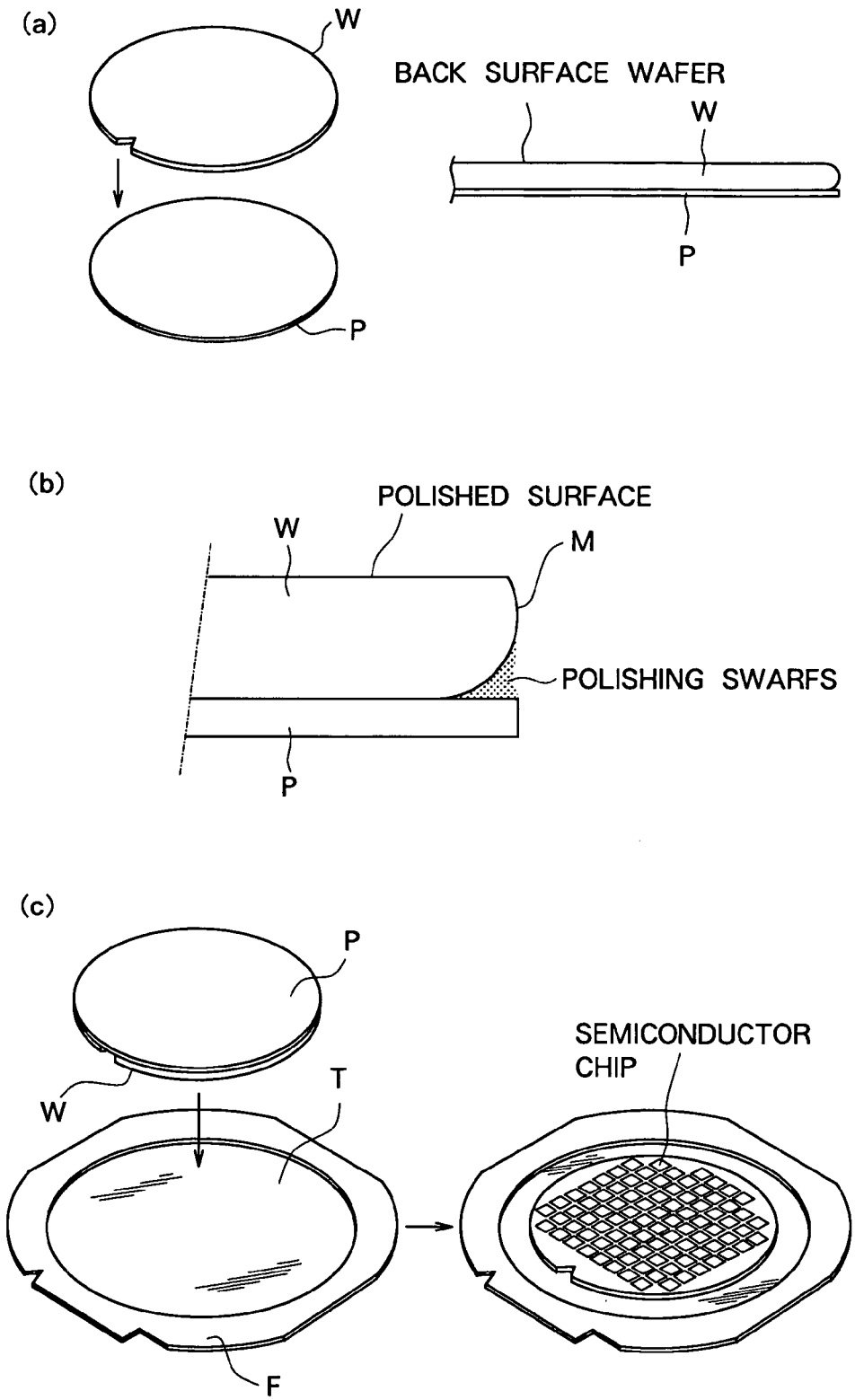
FIGS. 3(*a*), 3(*b*) and 3(*c*) are diagrams for explaining a problem of the prior art in the polishing of a wafer.

According to this wafer polishing method, since the arcuate chamfered portion M at the periphery of the wafer is cut as shown in FIG. 2(*a*) to form the precipice Z as shown in FIG. 2(*b*), the fissure-like depression (FIG. 3(*b*)) formed by the arcuate chamfered portion M at the periphery of the wafer W and the protective tape P is removed, thereby making it possible to prevent polishing swarfs from entering and accumulating in this portion and eliminate a problem that the polishing swarfs raise up the periphery of the wafer to damage the wafer. Since the entry and accumulation of the polishing swarfs can be thus prevented, a problem that a semiconductor chip is damaged by the polishing swarfs when the wafer W is diced to obtain semiconductor chips in the subsequent step can also be avoided.

The wafer polishing method of the present invention has been described above by taking a semiconductor wafer as an example. It is needless to say that the wafer is not limited to a semiconductor wafer and may be other type of wafer.

What we claim is:

1. A method of polishing a wafer with a polishing machine comprising a chuck table for holding a wafer and a polishing means for dry polishing the surface of a wafer held on a chuck table with a polishing pad manufactured by incorporating abrasive grains into a soft member, the method comprising the steps of:

cutting an arcuate chamfered portion formed at the periphery of the wafer to form a precipice at the periphery of the wafer;

affixing a protective tape onto the surface to be held on the chuck table, of the wafer;

placing the wafer on the chuck table in such a manner that the side of the protective tape comes into contact with the chuck table to dry polish the surface of the wafer with the polishing means; and dry polishing the surface of the wafer.

2. The wafer polishing method according to claim 1, wherein the protective tape protrudes 0 to 1.0 mm from the precipice at the periphery of the wafer.

3. The wafer polishing method according to claim 1, wherein the soft member of the polishing pad is a felt.

4. The wafer polishing method according to claim 1, wherein the wafer is a semiconductor wafer of which the front surface has a plurality of chips formed thereon, and the back surface of the wafer is polished.

* * * * *